US007234319B2

(12) United States Patent
Sone

(10) Patent No.: US 7,234,319 B2
(45) Date of Patent: Jun. 26, 2007

(54) THERMOSIPHON

(75) Inventor: Kazuya Sone, Niigata-ken (JP)

(73) Assignee: Twinbird Corporation (JP)

( * ) Notice: Subject to any disclaimer, the term of this patent is extended or adjusted under 35 U.S.C. 154(b) by 494 days.

(21) Appl. No.: 10/968,622

(22) Filed: Oct. 19, 2004

(65) Prior Publication Data

US 2005/0109057 A1 May 26, 2005

(30) Foreign Application Priority Data

Nov. 25, 2003 (JP) ..... 2003-394516

(51) Int. Cl.
*F25D 17/02* (2006.01)
*F28D 15/00* (2006.01)

(52) U.S. Cl. ..... 62/434; 165/104.21

(58) Field of Classification Search ..... 62/434, 62/333, 6, DIG. 22; 165/104.21, 104.11, 165/104.19

See application file for complete search history.

(56) References Cited

U.S. PATENT DOCUMENTS

| | | | | |
|---|---|---|---|---|
| 2,512,545 | A | 6/1950 | Hazard | |
| 2,946,206 | A | 7/1960 | Hellstrom | |
| 3,880,230 | A | 4/1975 | Pessolano et al. | |
| 4,449,576 | A | 5/1984 | Baum et al. | |
| 4,578,962 | A | 4/1986 | Dustmann | |
| 6,076,595 | A | 6/2000 | Austin et al. | |
| 6,725,907 | B2 * | 4/2004 | Sone | 165/104.21 |
| 7,013,954 | B2 * | 3/2006 | Sone | 165/104.21 |
| 2005/0081558 | A1 * | 4/2005 | Yoshida | 62/457.9 |

FOREIGN PATENT DOCUMENTS

| | | |
|---|---|---|
| EP | 1 167 900 A1 | 1/2002 |
| JP | 11211313 | 8/1999 |
| JP | 2001033139 | 2/2001 |
| JP | 2003148813 | 5/2003 |

* cited by examiner

*Primary Examiner*—Marc Norman
(74) *Attorney, Agent, or Firm*—Akerman Senterfitt

(57) ABSTRACT

A refrigerant-filled thermosiphon comprising: a condensing member for condensing the refrigerant, the condensing member being provided on a heat-absorbing section of a Stirling cycle cooler; and a pipe formed in an annular shape and connected to the condensing member, the pipe being arranged around a container so as to absorb a heat of the container, wherein the pipe comprises two paths, each path being arranged so as to extend downwardly along a half-periphery of the container. By employing this structure, the inclination angle of each path can be increased, and thus the flow of the liquefied refrigerant in the pipe can not be easily prevented even if a cooling box equipping the thermosiphon tilts in some degree.

9 Claims, 6 Drawing Sheets

THERMOSIPHON

BACKGROUND OF THE INVENTION

1. Field of the Invention

The present invention relates to a refrigerant-filled thermosiphon comprising: a condensing member provided on a heat-absorbing section of a refrigerating machine and condensing the refrigerant; a pipe connected to the condensing member and arranged around a container so as to absorb a heat of the container.

2. Description of the Related Art

As a conventional refrigerant-filled thermosiphon comprising: a condensing member provided on a heat-absorbing section of a refrigerating machine and condensing the refrigerant; a pipe connected to the condensing member and arranged around a container so as to absorb a heat of the container, the inventor of the present invention has proposed one in Japanese Unexamined Patent Publication No. 2003-148813, while this thermosiphon comprises: a condensing member equipped by a refrigerating machine for condensing a refrigerant (working fluid); a liquid pipe for discharging the working fluid condensed by the condensing member; an evaporating pipe vaporizing the working fluid from the liquid pipe, so as to absorb heat of a container; and a gas pipe for returning the working fluid vaporized in the evaporating pipe to the condensing member, wherein a height of at least the front portion of the evaporating pipe is gradually increased toward the liquid pipe. According to this structure, the working fluid condensed by the condensing member reaches the evaporating pipe via the liquid pipe, and returns to the condensing member from the evaporating pipe, and thus the heat of the container is absorbed throughout a process through which the liquefied working fluid circulates in the entire region of the evaporating pipe even if the amount of the working fluid is relatively a little, thereby improving the heat-absorbing efficiency.

In the above-described conventional technique, however, when a cooling box equipping the above thermosiphon tilts, the flow speed of the liquefied working fluid that circulates in the entire region of the evaporating pipe may be decreased, or the liquefied working fluid may not be circulated entirely, and thus an efficiency of absorbing the heat of the container on the evaporating pipe is lowered.

SUMMARY OF THE INVENTION

The present invention has been made to solve the above problem. It is, accordingly, an object of the present invention to provide a thermosiphon which can reduce the lowering of the efficiency of absorbing a heat of a container even if a cooling box equipping the thermosiphon tilts.

In order to attain the above object, according to a first aspect of the present invention, there is provided a refrigerant-filled thermosiphon, the thermosiphon comprising: a condensing member for condensing the refrigerant, the condensing member being provided on a heat-absorbing section of a refrigerating machine; and a pipe connected to the condensing member, the pipe being arranged around a container so as to absorb a heat of the container, wherein: the pipe comprises a plurality of paths, at least one of the paths being arranged so as to extend downwardly along a half-periphery of the container, while at least an other of the paths being arranged so as to extend downwardly along an other half-periphery of the container; and each path of the pipe is arranged so that a portion thereof going around a half-periphery of the container along the container defines a lowest portion.

According to the present invention, each path of the pipe is arranged so that a portion of each path going around a half-periphery of the container along the container defines a lowest portion, thus enlarging the inclination angle of the pipe compared to one employing a conventional structure that one path extends around the container. Accordingly, the flow of the refrigerant can not be easily prevented even if a cooling box equipping this thermosiphon tilts, and thus the likelihood to lower the efficiency of absorbing a heat of the container can be reduced. Moreover, since at least one of the paths extends downwardly along the half-periphery of the container, while at least the other of the paths extends downwardly along the other half-periphery of the container, the cooling efficiency of the container is not be reduced even if each path is arranged so as to extend along the half-periphery of the container.

Alternatively, in the above-described thermosiphon, the condensing member may be configured that the refrigerant is filled in the pipe and a portion of the pipe is thermally contacted by at least one heat-conduction block, the heat-conduction block being provided on a heat-absorbing section of the refrigerating machine.

Moreover, each path may define an individual path of the refrigerant, while all of the plurality of paths may be communicated to one another so as to form the single pipe.

Further, the pipe may be arranged multiply around the condensing member and the container, while the pipe may be made of copper.

Still further, the heat-conduction block may be made of aluminum.

BRIEF DESCRIPTION OF THE DRAWINGS

These objects, other objects and advantages of the present invention will become more apparent upon reading of the following detailed description and the accompanying drawings in which.

DETAILED DESCRIPTION OF THE PREFERRED EMBODIMENTS

Figure 1:
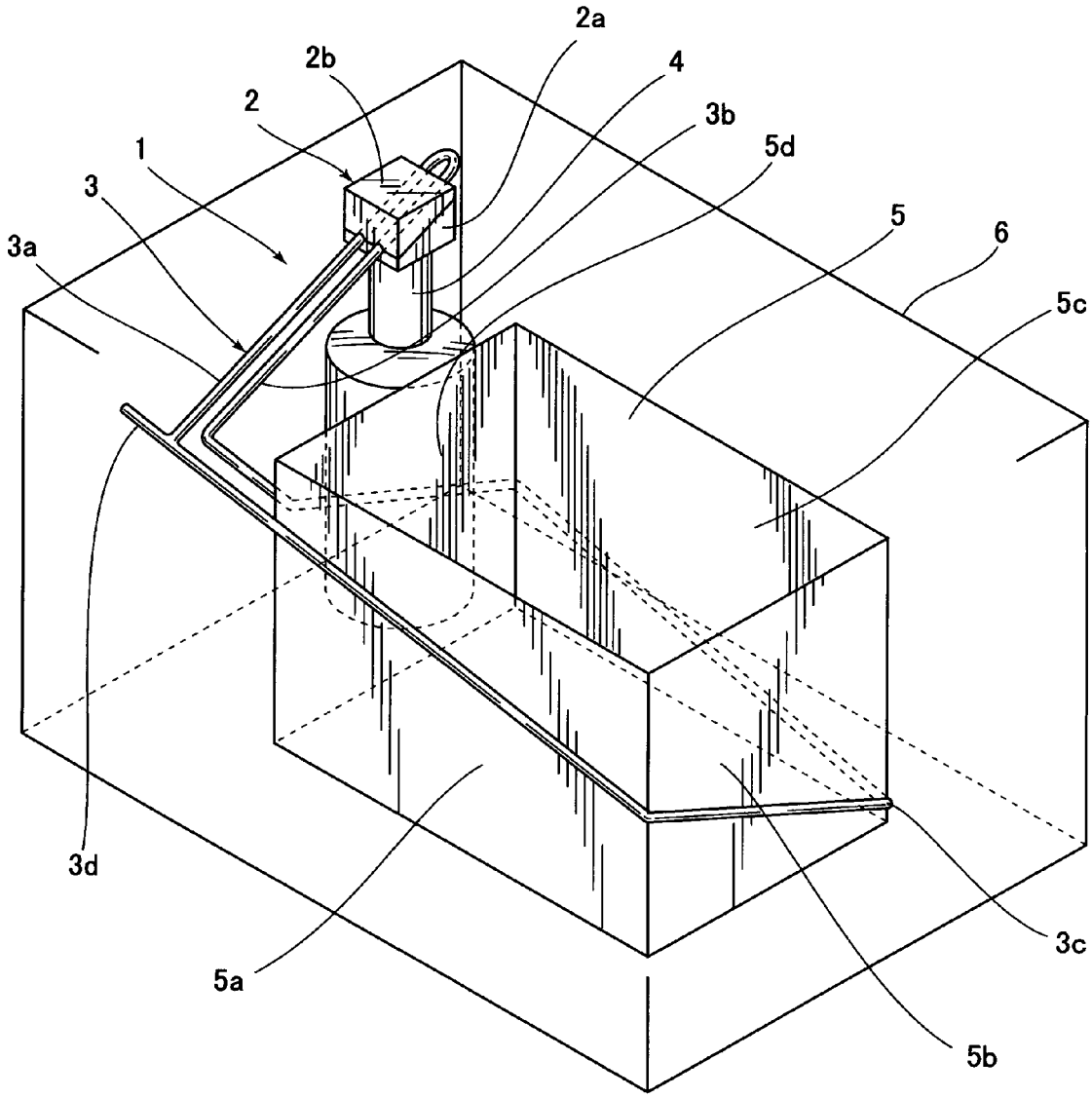
FIG. 1 is a perspective view showing a structure of a thermosiphon according to a first embodiment of the present invention.
Figure 2:
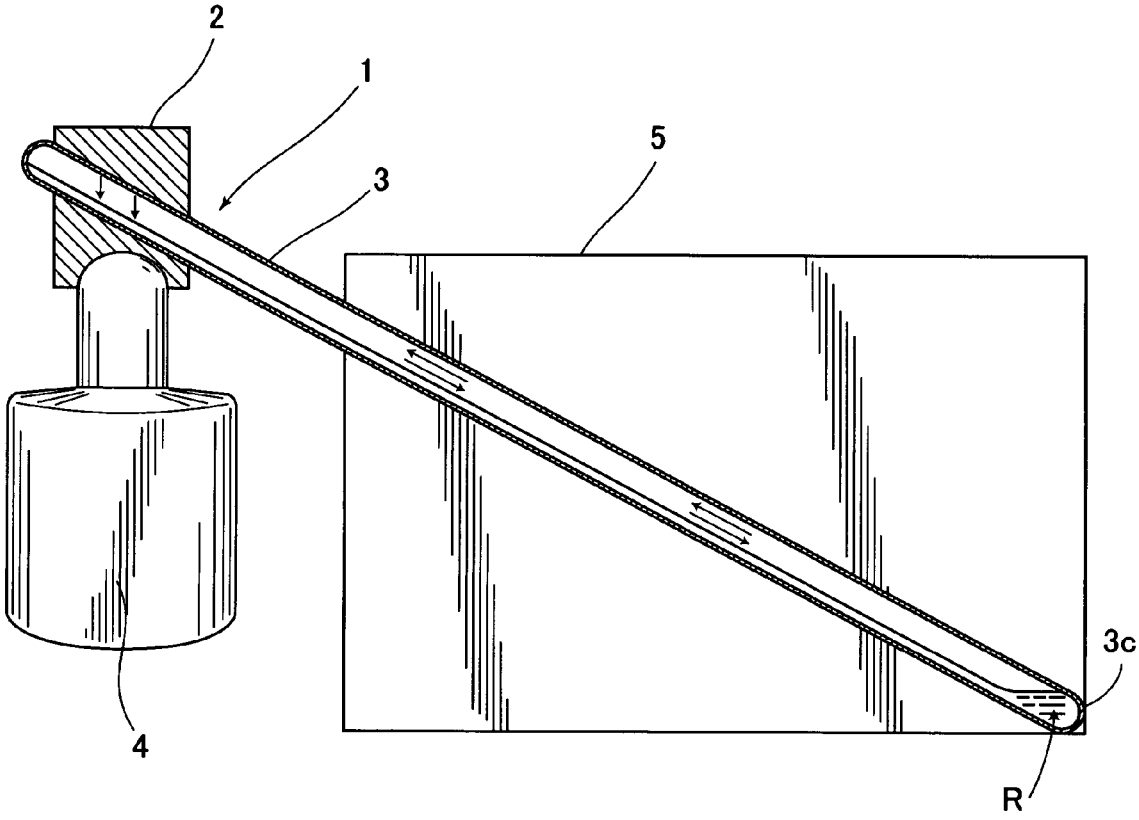
FIG. 2 is a view for explaining operations of the thermosiphon shown in FIG. 1.

Preferred embodiments of the present invention will now be described in detail with reference to the accompanying drawings. FIGS. 1 and 2 are for explaining a thermosiphon according to a first embodiment of the present invention.

FIG. 1 is a perspective view showing the refrigerant-filled thermosiphon 1 of this embodiment. The thermosiphon 1 comprises a condensing member 2 for condensing a refrigerant R, and a pipe 3 for absorbing a heat of a container.

The condensing member 2 is fixed on a heat-absorbing section which is formed on a distal end portion of a Stirling cooler (refrigerating machine) 4. Meanwhile, since the Stirling cooler 4 is well known by a person skilled in the art, detailed explanation thereof will be omitted in this specification. When the Stirling cooler 4 is operated, the distal end portion thereof works as the heat-absorbing section, thus absorbing a heat conducted from the condensing member 2. Moreover, the condensing member 2 employs a structure that it holds portions of the pipe 3 adjacent to an upper end thereof with an bottom block 2*a* and an upper block 2*b*, each working as a heat-conduction block. The bottom block 2*a* is fixed on the distal end portion of the Stirling cooler 4. Meanwhile, the fixation of the bottom block 2*a* to the Stirling cooler 4 can be carried out by, for instance, forming an opening on the bottom block 2*a* and pressing the distal end of the Stirling cooler 4 into the opening of the bottom block 2*a*, or bonding it to the Stirling cooler 4 with an adhesive of high heat-conductance. Moreover, the holding of the pipe 3 by the bottom and upper blocks 2*a* and 2*b* can be carried out by, for instance, forming a hole for a screw to the bottom block 2*a* from an upper surface thereof and forming another hole for the screw on a portion of the upper block 2*b* corresponding to the hole of the bottom block 2*a*, then inserting the screw into the hole of the upper block 2*b* from the upper surface side thereof and tightening them up. The bottom and upper blocks 2*a* and 2*b* are made from materials of high heat-conductance such as aluminum or the like.

Overall, the pipe 3 is formed in an annular shape. Two paths thereof are fixed on the condensing member 2 so that they extend obliquely downward and parallel with each other until they reach the outside surfaces of the container 5. One path 3*a* extends obliquely downward from the condensing member 2. After reaching the container 5, it extends while contacting a front surface 5*a* of the container 5, curves at a boundary between the front surface 5*a* and a right surface 5*b* so as to extend to the right surface 5*b*, and then reaches a boundary between the right surface 5*b* and a rear surface 5*c*. The other path 3*b* extends obliquely downward from the condensing member 2. After reaching the container 5, it extends while contacting a left surface 5*d*, curves at a boundary between the left surface 5*d* and the rear surface 5*c* so as to extend to the rear surface 5*c*, and then reaches a boundary between the rear surface 5*c* and the right surface 5*b*. The one path 3*a* and the other path 3*b* are integrally connected with each other at the boundary between the right surface 5*b* and the rear surface 5*c*, while a portion in which both paths 3*a* and 3*b* are connected is arranged as a lowest portion 3*c*. Inclinations of the portions of both paths 3*a* and 3*b* contacting the container 5 are essentially constant. Moreover, both paths 3*a* and 3*b* are integrally connected with each other at the upward of the condensing member 2. Meanwhile, an inlet 3*d* for filling the refrigerant R is formed on the one path 3*a*. The pipe 3 is made of, for instance, a copper pipe of high heat-conductance. The refrigerant is filled in the pipe 3. Carbon dioxide, hydrochlorofluorocarbon (HCFC), hydrofluorocarbon (HFC) or the like can be used as the refrigerant.

By accommodating the thermosiphon 1, the Stirling cooler 4 and the container 5 in a case 6, a cooling box is to be composed. In the case 6, the outsides of the thermosiphon 1 and container 5 are covered with a non-illustrated thermal insulator.

Explanation will now be made to assembling procedures of the thermosiphon 1 employing the above-described structure. First of all, one or more copper pipes are bent, while their ends are joined so as to form the pipe 3 in a predetermined shape, that is, an annular shape shown in FIG. 1, and then the inlet 3*d* is formed on a halfway portion of the pipe 3. The refrigerant is filled via the inlet 3*d*, and when the predetermined amount of the refrigerant is filled, the inlet 3*d* is sealed. Then, the pipe 3 is arranged so that the one path 3*a* extends downwardly along the front surface 5*a* of the container 5 and the right surface 5*b* thereof, the other path 3*b* extends downwardly along the left surface 5*d* of the container 5 and the rear surface 5*c* thereof, and the both ends of the paths 3*a* and 3*b* as the lowest portion 3*c* is arranged at the boundary between the right surface 5*b* and the rear surface 5*c*. Moreover, each of the paths 3*a* and 3*b* around the container 5 is thermally contacted by the container 5, while outside of the container 5 with the pipe 3 is covered with the non-illustrated thermal insulator. Further, the condensing member 2 is formed by holding the portions of the pipe 3 adjacent to the upper end thereof with the bottom block 2*a* prefixed on the Stirling cooler 4 and the upper block 2*b*. Still further, a portion of the pipe 3 away from the condensing member 2 and the container 5 is covered with the non-illustrated thermal insulator. The above-described thermosiphon 1 is thus formed in this way. Meanwhile, in a procedure of filling the refrigerant in the pipe 3, since the pipe 3 has two paths 3*a*, 3*b* and both of them are communicated with each other, the entire volume of the pipe 3 is equal to the sum of the volumes of the paths 3*a*, 3*b*, and thus it is easy to control the amount of the refrigerant filled in the pipe 3 so that the density of the refrigerant therein is to be a predetermined value, thereby improving the accuracy of the filling of the refrigerant. For instance, in a thermosiphon employing a conventional structure, in a case where an error of ±0.5 g is to be observed for the amount of the filled refrigerant, the error relative to the single path formed by a pipe will be ±0.5 g, and in a case filling the refrigerant in a plurality of paths, the error of ±0.5 g can be observed relative to each path. According to the first embodiment, however, the error of ±0.5 g can be entirely observed for the pipe 3 having two paths 3*a*, 3*b*, and thus an apparent error relative to each path 3*a*, 3*b* can be ±0.25 g. In other words, by dividing up the overall error of the amount of the refrigerant relative to the pipe 3 by the number of paths 3*a*, 3*b*, the apparent error relative to each path 3*a*, 3*b* can be decreased (in this first embodiment, about one-half).

Next, operations of the thermosiphon 1 employing the above-described structure will now be described. FIG. 2 is a view for explaining operations of the thermosiphon 1. As explained, when the Stirling cooler 4 is operated, the heat-absorbing section formed on the distal end portion of the Stirling cooler 4 is cooled off. When the heat-absorbing section of the Stirling cooler 4 is cooled off, the condensing member 2 fixed on the distal end portion of the Stirling cooler 4 is cooled off. When the condensing member 2 is cooled off, the portions of the pipe 3 held by the blocks 2*a*, 2*b* and configuring the condensing member 2 are cooled off. When the pipe 3 is cooled off, the refrigerant filled therein is condensed. The condensed refrigerant flows each path 3*a*, 3*b* obliquely extending downward. The liquefied refrigerant which are flowing each path 3*a*, 3*b* absorbs a heat of the container 5 and evaporates while reaching the lowest portion 3*c* of the paths 3*a*, 3*b*, and the remaining of the liquefied refrigerant not evaporated is collected at the lowest portion 3*c* of the paths 3*a*, 3*b*. Accordingly, in a condition that the lowest portion 3*c* is filled with the liquefied refrigerant, the refrigerant evaporated in the path 3*a* or 3*b* does not travel to other path 3*b* or 3*a*, but inversely drifts up the path 3*a* or 3*b* (the path in which the refrigerant evaporated) and returns to the condensing member 2. The refrigerant returned to the condensing member 2 is condensed again. The container 5 is cooled by repeating the above-described processes.

As explained above, according to the first embodiment, the pipe 3 comprises: the path 3*a* extending along a half-periphery defined by the front surface 5*a* of the container 5 and the right surface 5*b* thereof; and the path 3*b* extending along the other half-periphery defined by the rear surface 5*c* of the container 5 and the left surface 5*d* thereof, wherein both ends of the paths 3*a* and 3*b* extending along the half-peripheries of the container 5 is arranged as the lowest portion 3*c*, and thus the inclination of the pipe 3 can be a little lesser than twice as much as that of the conventional structure in which a single path is arranged around the container 5, when the shape of the container 5 is same. Accordingly, the flow of the refrigerant would not be easily prevented even if a cooling box equipping the thermosiphon 1 tilts, thus reducing the lowering of the efficiency of absorbing the heat of the container 5. Moreover, since both paths 3*a* and 3*b* are connected with each other at the lowest portion 3*c*, the level of the liquefied refrigerant on each paths 3*a* and 3*b* flowing there and collected at the lowest portion 3*c* would be same, and thus the refrigerant can evenly circulate in both paths 3*a* and 3*b*. Further, since the paths 3*a* and 3*b* are connected with each other at the upward of the condensing member 2, gas of the refrigerant can evenly circulate in both paths 3*a* and 3*b* without unevenly circulating either the one path 3*a* or the other path 3*b*.

Moreover, according to the first embodiment, since the condensing member 2 is configured that the refrigerant is filled in the pipe 3, the portions of the pipe 3 are held by the bottom block 2*a* provided on the heat-absorbing section of the Stirling cooler 4, and the upper block 2*b*, the easiness of assembling the thermosiphon 1 can be improved.

Further, according to the first embodiment, by filling the refrigerant from the inlet 3*d*, the following effectiveness can be obtained: the refrigerant can be entirely diffused across the pipe 3, and thus the filling of the refrigerant therein can be made easy; the refrigerant can be evenly diffused across the paths 3*a* and 3*b*, and thus the cooling performance of each path 3*a*, 3*b* can be essentially equal. Moreover, since the refrigerant can be entirely diffused across the pipe 3, the entire volume of the pipe 3 filling the refrigerant can be enlarged, and thus the control of the amount of the refrigerant so as to obtain a predetermined density of the filled refrigerant can be made easy. Therefore, accuracy of the amount of the refrigerant in the pipe 3 can be enhanced.

Figure 3:
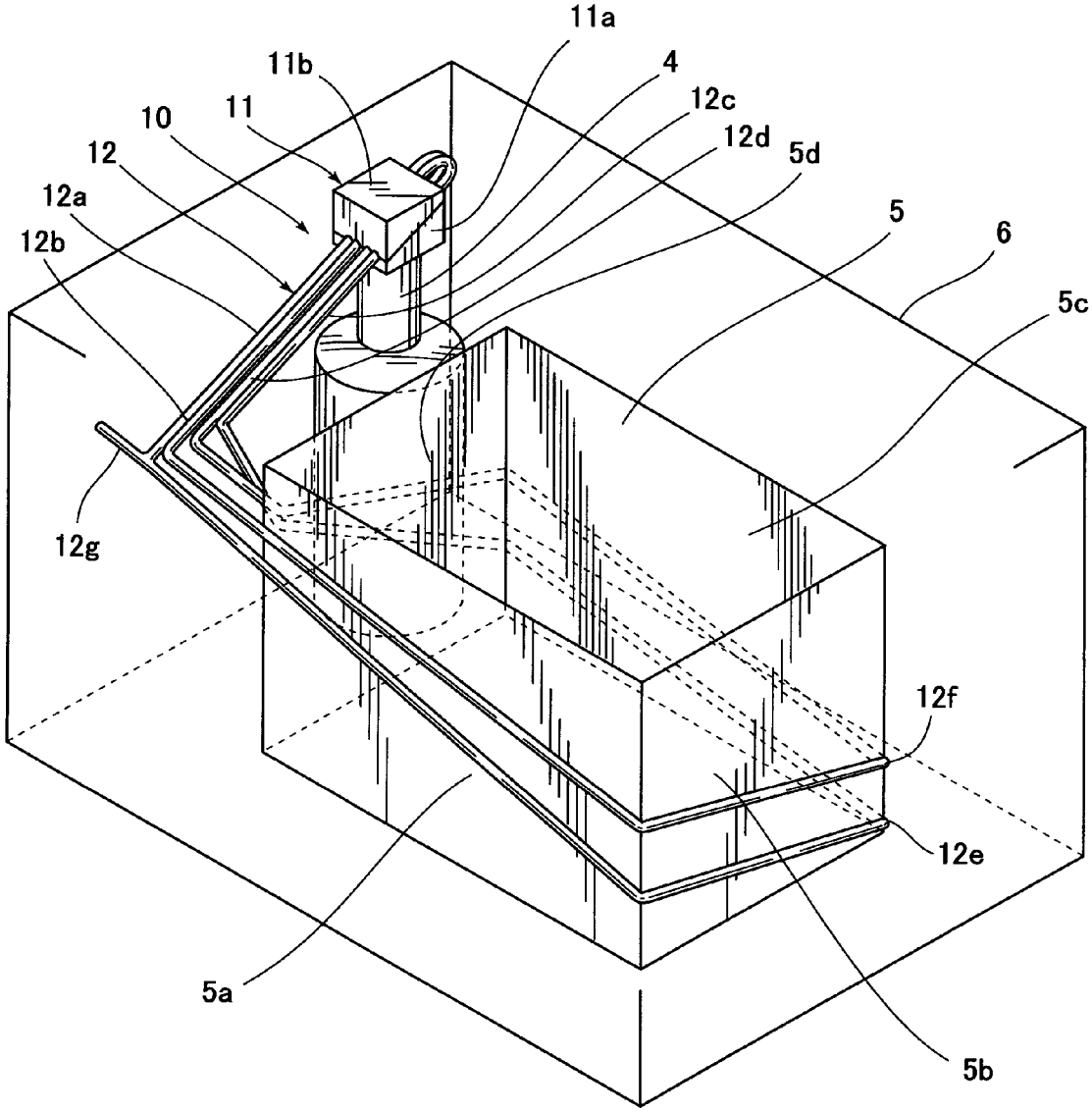
FIG. 3 is a perspective view showing a structure of a thermosiphon according to a second embodiment of the present invention.

Next, a thermosiphon according to a second embodiment of the present invention will now be described. FIG. 3 is for explaining a thermosiphon according to the second embodiment of the present invention. Meanwhile, in the second embodiment, the same reference numbers will denote the same structure portions of a thermosiphon of the first embodiment, while detailed explanations thereof will be omitted.

FIG. 3 shows the thermosiphon 10 of this embodiment. The thermosiphon 10 comprises a condensing member 11 for condensing a refrigerant, and a pipe 12 for absorbing a heat of the container 5.

The condensing member 11 is configured by holding portions of the pipes 12 adjacent to upper end thereof with a bottom block 11*a* and an upper block 11*b*. Meanwhile, the condensing member 11 is one that the condensing member 2 of the first embodiment is modified so as to hold the pipe 12. Moreover, the pipe 12 is one that the pipe 3 of the first embodiment is doubled.

A first path 12*a* and a second path 12*b* contact the front and right surfaces 5*a* and 5*b* as same as the path 3*a* of the first embodiment. A third path 12*c* and a fourth path 12*d* contact the left and rear surfaces 5*d* and 5*c* as same as the path 3*b* of the first embodiment. An inclination angle of the first path 12*a* is essentially same as that of the third path 12*c*, while the inclination angle of the second path 12*b* is essentially same as that of the fourth path 12*d*. On the boundary between the right surface 5*b* and the rear surface 5*c*, the first path 12*a* and the third path 12*c* are integrally connected with each other so as to form a lowest portion 12*e*. On the boundary between the right surface 5*b* and the rear surface 5*c*, the second path 12*b* and the fourth path 12*d* are integrally connected with each other so as to form a lowest portion 12*f*. The first path 12*a* and the fourth path 12*d* are integrally connected with each other on the upward of the condensing member 11. The second path 12*b* and the third path 12*c* are integrally connected with each other on the upward of the condensing member 11. Accordingly, four of the paths 12*a*, 12*b*, 12*c* and 12*d* form the single, annular pipe 12. An inlet 12*g* for filling the refrigerant R is formed on a portion of the first path 12*a*.

Assembling procedures of the thermosiphon 10 and operations thereof are basically same as those of the thermosiphon 1 of the first embodiment, thus omitting the detailed explanations thereof.

According to the second embodiment, the pipe 12 is doubly arranged around the condensing member 11 and the container 5, the efficiency of absorbing the heat of the container 5 can be improved compared to the first embodiment.

Further, according to the second embodiment, by filling the refrigerant from the inlet 12*g*, the following effectiveness can be obtained: the refrigerant can be entirely diffused across the pipe 12, and thus the filling of the refrigerant therein can be made easy; the refrigerant can be evenly diffused across the paths 12*a*-12*d*, and thus the cooling performance of each path 12*a*, 12*b*, 12*c*, 12*d* can be essentially equal. Moreover, since the refrigerant can be entirely diffused across the pipe 12, the entire volume of the pipe 12 filling the refrigerant can be enlarged, and thus the control of the amount of the refrigerant so as to obtain a predetermined density of the filled refrigerant can be made easy. Therefore, accuracy of the amount of the refrigerant in the pipe 12 can be enhanced.

Figure 4:
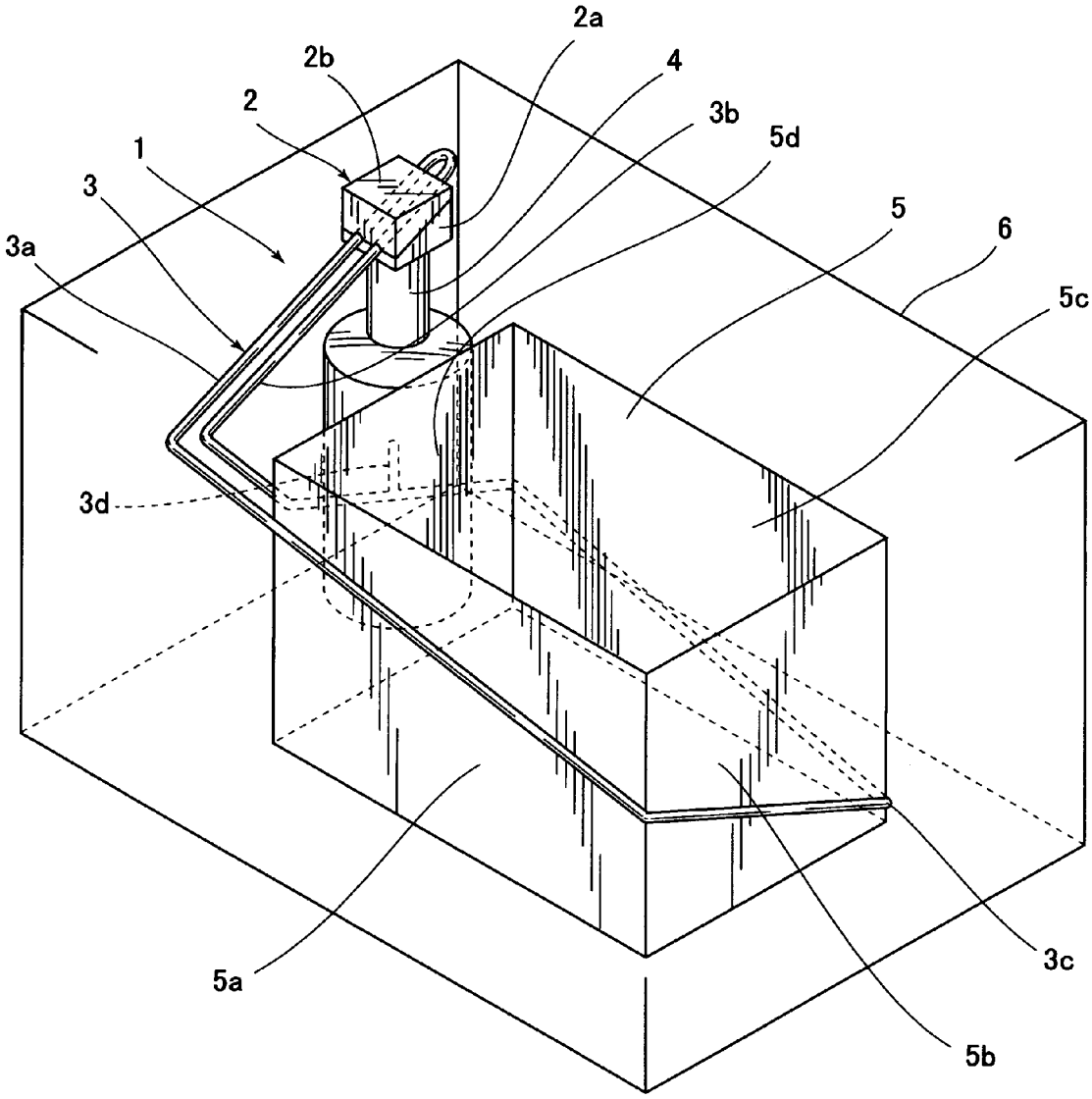
FIG. 4 is a perspective view showing a structure of a thermosiphon according to a third embodiment of the present invention.
Figure 5:
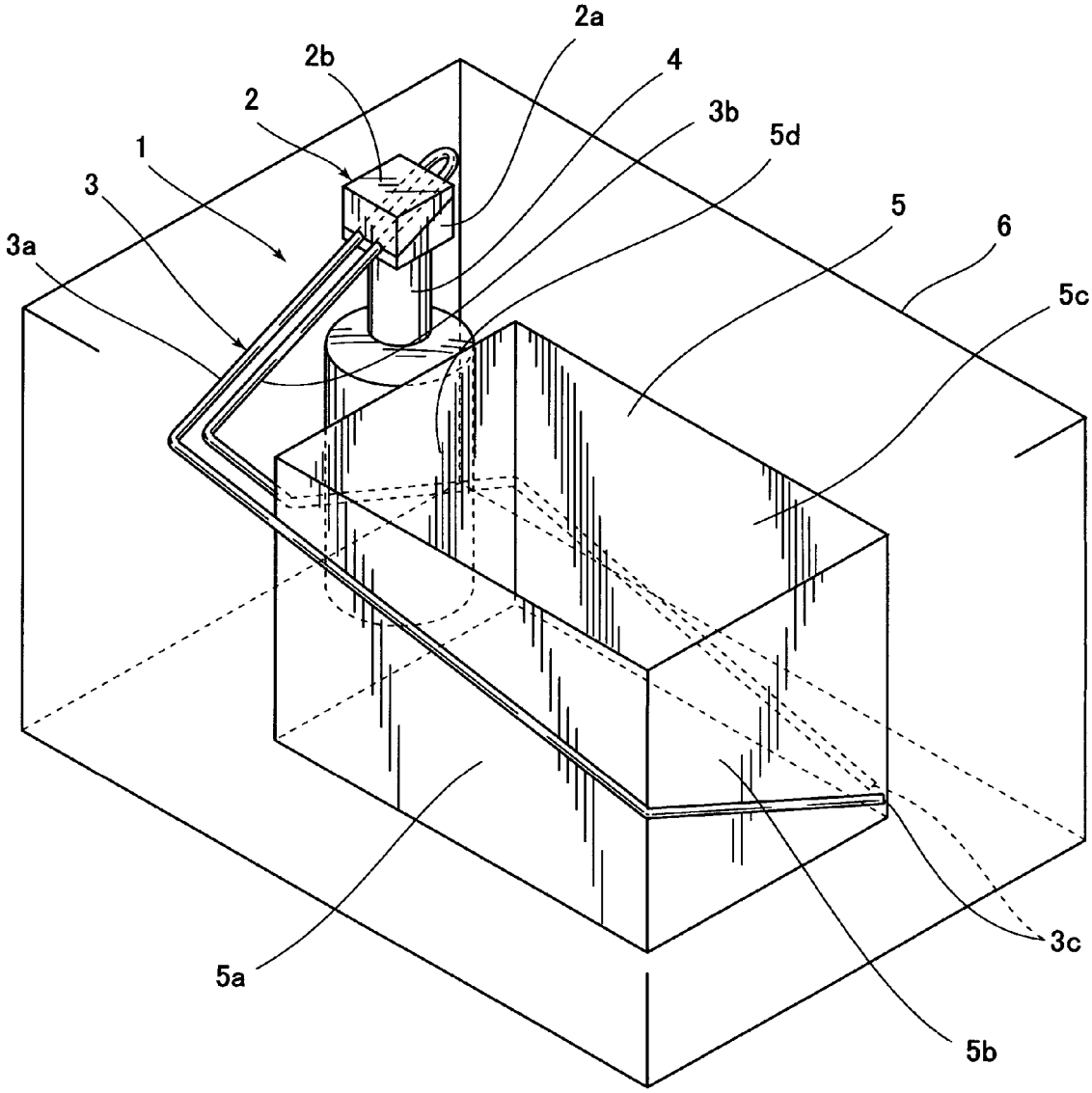
FIG. 5 is a perspective view showing a structure of a thermosiphon according to a fourth embodiment of the present invention.
Figure 6:
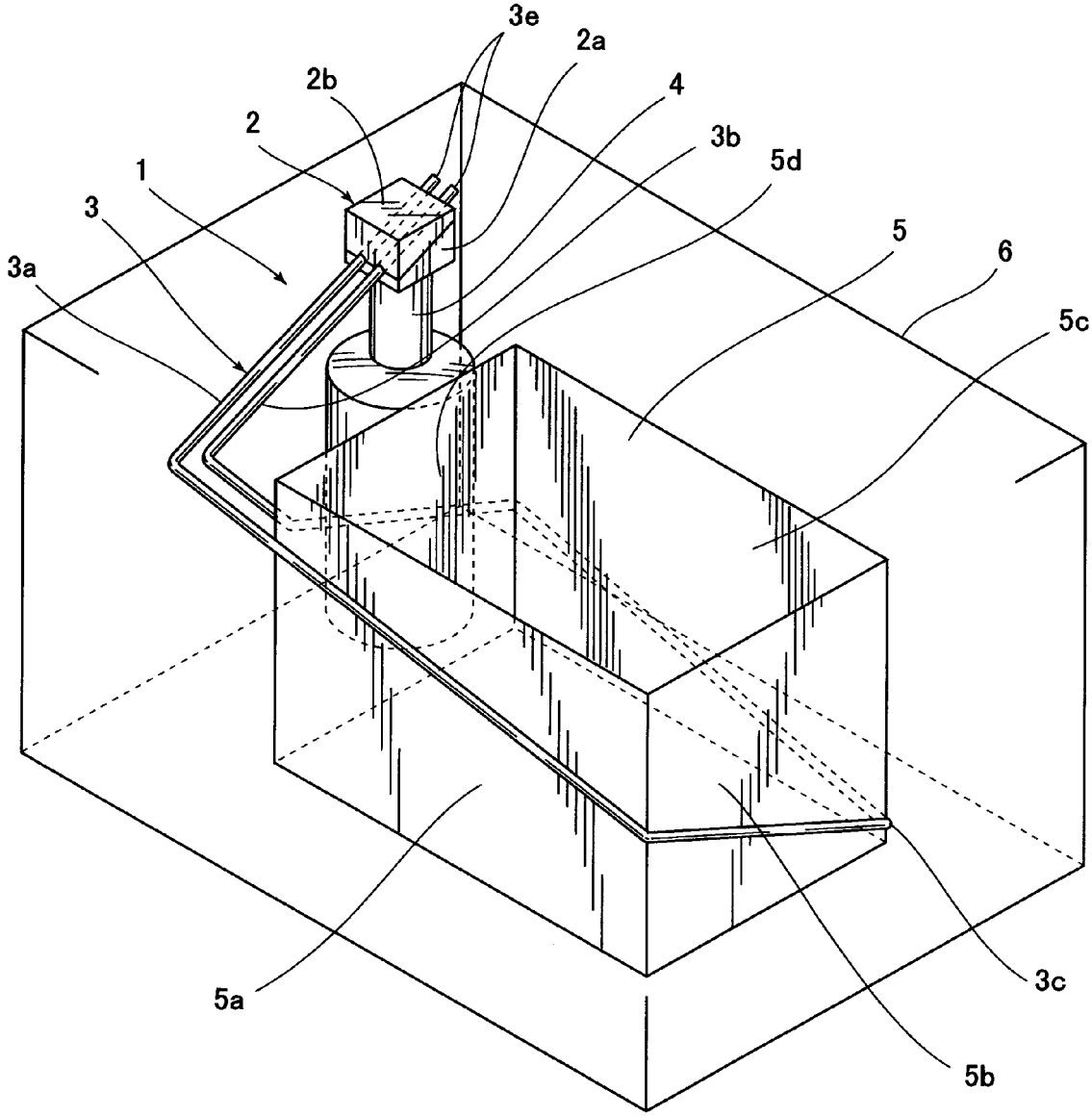
FIG. 6 is a perspective view showing a structure of a thermosiphon according to a fifth embodiment of the present invention.

The present invention is not limited to the above embodiments, various embodiments and changes may be made thereonto without departing from the broad spirit and scope of the invention. For instance, as shown in FIG. 4, the inlet 3*d* may be provided on a portion of the path 3*b* along the periphery of the container 5 (third embodiment). By providing the inlet 3*d* at this position, the outside of the container 5 including the inlet 3*d* can be covered with the non-illustrated thermal insulator. Accordingly, a portion of the pipe 3 not covered with the thermal insulator, that is, the portion of the pipe 3 which extends from the condensing member 2 and contacts the outside surface of the container 5 can be formed in a simple shape, and thus this portion can be easily covered with the other thermal insulator. Moreover, whilst the pipe 3 is formed in an annular shape in the above embodiments, but it may be in a shape that the lowest portion 3*c* is divided in two pieces as shown in FIG. 5 (fourth embodiment). By employing this structure, the outside of the container 5 including the lowest portion 3*c* can be covered with the non-illustrated thermal insulator. Accordingly, a portion of the pipe 3 not covered with the thermal insulator, that is, the portion of the pipe 3 which extends from the condensing member 2 and contacts the outside surface of the container 5 can be formed in a simple shape, and thus this portion can be easily covered with the other thermal insulator. Further, as shown in FIG. 6, a highest portion 3*e* of the pipe 3 provided upward of the condensing member 2 may be separated (fifth embodiment). By employing this structure, the refrigerant can be filled after the pipe 3 is fixed on the periphery of the container 5 and covered with the thermal insulator, and thus the degree of freedom for the assembling order can be improved. Meanwhile, in all of those embodiments, since the paths 3*a* and 3*b* are communicated with each other, the same effectiveness as that of the first embodiment can be obtained. Still further, in the second embodiment, whilst the pipe 3 is doubly arranged around the container 5, but it may be arranged more than or equal to triply around the container 5.

What is claimed is:

1. A refrigerant-filled thermosiphon, said thermosiphon comprising: a condensing member for condensing the refrigerant, said condensing member being provided on a heat-absorbing section of a refrigerating machine; and a pipe connected to said condensing member, said pipe being arranged around a container so as to absorb a heat of the container, wherein:

said pipe comprises a plurality of paths, at least one of said paths being arranged so as to extend downwardly along a half-periphery of the container, while at least an other of said paths being arranged so as to extend downwardly along an other half-periphery of the container; and each path of said pipe is arranged so that a portion thereof going around the half-periphery of the container along the container defines a lowest portion.

2. The thermosiphon according to claim 1, wherein said condensing member is configured that the refrigerant is filled in said pipe and at least a portion of said pipe is thermally contacted by at least one heat-conduction block, the heat-conduction block being provided on the heat-absorbing section of the refrigerating machine.

3. The thermosiphon according to claim 2, wherein each path defines an individual path of the refrigerant, while all of said plurality of paths are communicated to one another so as to form said single pipe.

4. The thermosiphon according to claim 3, wherein said pipe is arranged multiply around said condensing member and the container.

5. The thermosiphon according to claim 2, wherein said pipe is arranged multiply around said condensing member and the container.

6. The thermosiphon according to claim 2, wherein said heat-conduction block is made of aluminum.

7. The thermosiphon according to claim 1, wherein each path defines an individual path of the refrigerant, while all of said plurality of paths are communicated to one another so as to form said single pipe.

8. The thermosiphon according to claim 7, wherein said pipe is arranged multiply around said condensing member and the container.

9. The thermosiphon according to claim 1, wherein said pipe is made of copper.

* * * * *